US010265570B2

(12) United States Patent
Chou

(10) Patent No.: US 10,265,570 B2
(45) Date of Patent: Apr. 23, 2019

(54) EXERCISE MACHINE WITH FLEXIBLE HANDLES

(71) Applicant: Cheng I. Chou, City of Industry, CA (US)

(72) Inventor: Cheng I. Chou, City of Industry, CA (US)

( * ) Notice: Subject to any disclaimer, the term of this patent is extended or adjusted under 35 U.S.C. 154(b) by 297 days.

(21) Appl. No.: 15/231,754

(22) Filed: Aug. 8, 2016

(65) Prior Publication Data

US 2017/0036059 A1 Feb. 9, 2017

Related U.S. Application Data

(60) Provisional application No. 62/202,166, filed on Aug. 7, 2015.

(51) Int. Cl.

| | |
|---|---|
| ***A63B 21/00*** | (2006.01) |
| ***A63B 1/00*** | (2006.01) |
| ***A63B 21/06*** | (2006.01) |
| ***A63B 23/035*** | (2006.01) |
| ***A63B 23/04*** | (2006.01) |
| ***A63B 23/12*** | (2006.01) |
| ***A63B 21/062*** | (2006.01) |

(52) U.S. Cl.

CPC ..... *A63B 21/4035* (2015.10); *A63B 1/00* (2013.01); *A63B 21/00065* (2013.01); *A63B 21/00069* (2013.01); *A63B 21/06* (2013.01); *A63B 21/063* (2015.10); *A63B 21/0628* (2015.10); *A63B 21/4029* (2015.10); *A63B 23/03516* (2013.01); *A63B 23/04* (2013.01); *A63B 23/1218* (2013.01); *A63B 21/0632* (2015.10)

(58) Field of Classification Search

None

See application file for complete search history.

(56) References Cited

U.S. PATENT DOCUMENTS

| | | | | |
|---|---|---|---|---|
| 7,785,243 | B2 * | 8/2010 | Kassel | A63B 21/00185 482/121 |
| 8,007,413 | B1 * | 8/2011 | Wu | A63B 21/068 482/131 |
| 8,043,197 | B2 * | 10/2011 | Hetrick | A63B 21/0023 482/91 |
| 9,883,735 | B2 * | 2/2018 | Moreau | A45F 5/02 |
| 9,968,180 | B2 * | 5/2018 | Moreau | A45F 5/021 |
| 2004/0185990 | A1 * | 9/2004 | Orescan | A63B 21/0552 482/126 |
| 2013/0157821 | A1 * | 6/2013 | Crowell | A63B 21/0442 482/129 |

(Continued)

*Primary Examiner* — Stephen R Crow

(74) *Attorney, Agent, or Firm* — Raymond Y. Chan; David and Raymond Patent Firm

(57) ABSTRACT

An exercise machine includes a supporting frame, a weight provider which is supported by the supporting frame for providing different adjustable resistance levels, a body exercising system operatively coupled at the supporting frame to link with the weight provider, and two flexible handles. Each of the flexible handles includes an elongated flexible strip, a fastening member affixed to a first end of the flexible strip to form a coupling end of the flexible handle for detachably coupling at the upper body exercising system, and a handgrip affixed to an opposed second end of said flexible strip to form a handgrip end of the flexible handle for enabling an exerciser to perform free motion press and fly exercises.

19 Claims, 3 Drawing Sheets

(56) References Cited

U.S. PATENT DOCUMENTS

| | | | | |
|---|---|---|---|---|
| 2014/0323275 | A1* | 10/2014 | Moses, II | A63B 21/1627<br>482/40 |
| 2017/0036059 | A1* | 2/2017 | Chou | A63B 21/0628 |
| 2018/0035794 | A1* | 2/2018 | Slovis | A45F 5/10 |

* cited by examiner

EXERCISE MACHINE WITH FLEXIBLE HANDLES

CROSS REFERENCE OF RELATED APPLICATION

This is a non-provisional application that claims priority to U.S. provisional application, application No. 62/202,166, filed Aug. 7, 2015, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an exercise device, and more particular to an exercise machine, wherein a flexible handle can be selectively and quickly coupled at different locations of the exercise machine for performing free motion press and fly exercises.

Description of Related Arts

A multi-functional exercise machine has been developed for exercising various muscle groups of the exerciser's body. Accordingly, most manufacturers build the multi-functional exercise machine as a "home gym" exercise equipment that can provide a full body strength training workout in the privacy of one's own home. However, this compact exercise equipment has a major drawback that it can only enable the exerciser to perform limited exercises.

For example, an existing exercise equipment generally comprises a supporting frame supporting a weight stack thereat, a seat pad coupled to the supporting frame, and different components pre-configured to the supporting frame to perform different upper body exercises. Accordingly, two chest press handles are pivotally coupled at the supporting frame, and an overhead pulldown handlebar is coupled to the supporting frame via a pulley system. Therefore, the exerciser can sit on the seat pad and grasp the chest press handles to push the chest press handles away from his or her body. Likewise, the exerciser can sit on the seat pad and grasp the overhead pulldown handlebar to pull down the overhead pulldown handlebar towards his or her body. These exercises tend to work the upper body muscles of the exerciser. As it is mentioned above, this exercise equipment can only provide a single path of motion for exercise that the chest press handles and overhead pulldown handlebar are limited to a single orientation of the hands when grasped. Since the structure of the exercise equipment is not expandable, all different exercises are preset by different irremovable components.

SUMMARY OF THE PRESENT INVENTION

The invention is advantageous in that it provides an exercise machine, wherein a flexible handle can be selectively and quickly coupled at different locations of the exercise machine for performing free motion press and fly exercises, such as PEC (pectoral) exercise, row exercise, LAT (latissimus) pulldown exercise.

Another advantage of the invention is to provide an exercise machine, wherein a coupling end of the flexible handle is formed with a tubular fastening member that the bench handle can be slidably inserted into the fastening member in order to quickly and securely couple the flexible handle with the bench handle.

Another advantage of the invention is to provide an exercise machine, wherein the flexible handle can be selectively and detachably couple at the press arm or the overhead pulldown handlebar.

Another advantage of the invention is to provide an exercise machine, wherein various fastening structures are provided at the flexible handle to be selectively and quickly coupled at different locations of the exercise machine.

Another advantage of the invention is to provide an exercise machine, wherein the length of the flexible handle is adjustable.

Another advantage of the invention is to provide an exercise machine, which does not require altering the original structural design of the exercise machine, so as to minimize the manufacturing cost of an exercise machine that incorporates the flexible handle.

Another advantage of the invention is to provide an exercise machine, wherein no expensive or complicated structure is required to employ the present invention in order to achieve the above mentioned objectives. Therefore, the present invention successfully provides an economic and efficient solution for providing various hand orientations for the exercise machine to enable the exerciser to perform free motion press and fly exercises.

Additional advantages and features of the invention will become apparent from the description which follows, and may be realized by means of the instrumentalities and combinations particularly pointed out in the appended claims.

According to the present invention, the foregoing and other objectives and advantages are attained by an exercise machine which comprises a supporting frame, a weight provider supported by the supporting frame for providing different adjustable resistance levels, and a body exercising system operatively coupled at the supporting frame to link with the weight provider. The exercise machine further comprises two flexible handles, wherein each of the flexible handles has a handgrip end and a coupling end detachably coupled at the body exercising system for enabling an exerciser to perform fly exercises.

In accordance with another aspect of the invention, the present invention comprises a handle assembly for an exercise machine, which comprises two flexible handles, wherein each of the flexible handles comprises an elongated flexible strip, a fastening member affixed to a first end of the flexible strip to form a coupling end of the flexible handle for detachably coupling at the press arm, and a handgrip affixed to an opposed second end of the flexible strip to form a handgrip end of the flexible handle.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
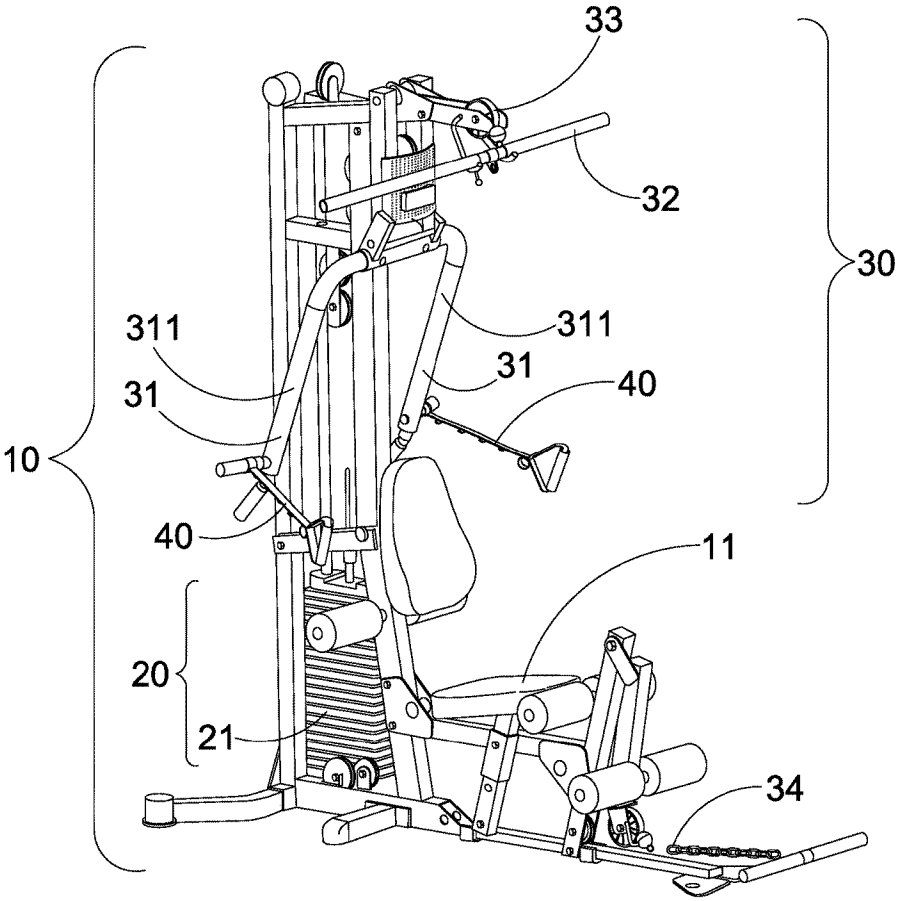
FIG. 1 is a perspective view of an exercise machine according to a preferred embodiment of the present invention.

Referring to FIG. 1 of the drawings, an exercise machine according to a preferred embodiment of the present invention is illustrated, wherein the exercise machine can be a "home gym" exercise equipment to provide a full body strength training workout for an exerciser.

According to the preferred embodiment, the exercise machine comprises a supporting frame 10, a weight provider 20 supported by the supporting frame 10 for providing different adjustable resistance levels, and a body exercising system 30 operatively coupled at the supporting frame 10 to link with the weight provider 20.

As shown in FIG. 1, the supporting frame 10 comprises a seat pad 11 for enabling the exerciser to sit. The weight provider 20 comprises a plurality of weight members being stacked to form a weight stack 21, wherein the exerciser is able to select numbers of weight members to adjust the resistance levels of the weight stack 21.

Figure 2:
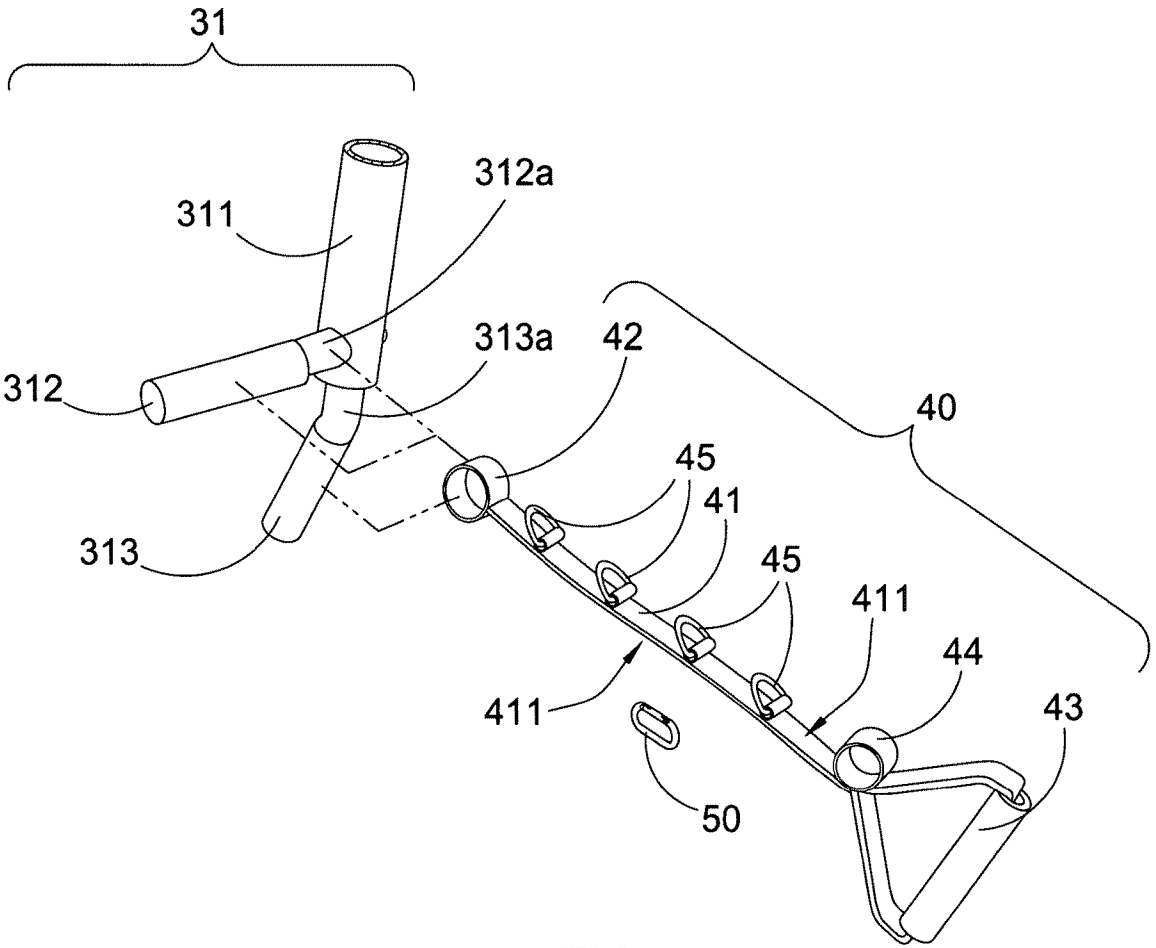
FIG. 2 is a perspective view of the flexible handle of the exercise machine according to the above preferred embodiment of the present invention, illustrating the flexible handle being coupled at the press arm.

The body exercising system 30 comprises a pulley unit 33 operatively linked to the weight stack 21, a chest press 31 and an overhead pulldown handle 32. The chest press 31, having a U-shaped configuration, is pivotally coupled with the supporting frame 10 to operatively link to the pulley unit 33. The chest press 31 has two press arms 311. As shown in FIGS. 1 and 2, each of the press arms 311 comprises a horizontal bench handle 312 perpendicularly extended from a free end of the press arm 311 and a tilted bench handle 313 inclinedly extended from the free end of the press arm 311, wherein the horizontal bench handle 312 and the tilted bench handle 313 provide two different hand orientations. Accordingly, each of the bench handles 312, 313 has a handgrip portion for the exerciser grasping thereat and a root portion extended between the handgrip portion and the free end of the press arm 311. The overhead pulldown handlebar 32 is suspendedly coupled at an upper portion of the supporting frame 10 and is operatively coupled to the pulley unit 33. It is worth mentioning that the body exercising system 30 further comprises a lower body exercising component 34 operatively linked to the pulley unit 33, wherein the lower body exercising component 34 can be linked to the pulley unit 33 via one or more intermediate pulleys.

The exercise machine further comprises a handle assembly as an add-on handle assembly to the exercise machine. The handle assembly comprises two flexible handles 40, wherein each of the flexible handles 40 has a handgrip end and a coupling end detachably coupled at the body exercising system 30 for enabling an exerciser to perform free motion press and fly exercises.

As shown in FIG. 2, each of the flexible handles 40 comprises an elongated flexible strip 41, a fastening member 42 affixed to a first end of the flexible strip 41 to form the coupling end of the flexible handle 40, and a handgrip 43 affixed to an opposed second end of the flexible strip 41 to form the handgrip end of the flexible handle 40.

The flexible strip 41 is preferably made of durable but flexible fabric to form a fabric strip, wherein the flexible strip 41 has two opposed flat surfaces 411. In other words, the flexible strip 41 can be folded or twisted to enable the exerciser to perform the free motion press.

The fastening member 42 has a tubular shape and defines a receiving cavity, wherein each of the bench handles 312, 313 is adapted to slidably pass through the receiving cavity of the fastening member 42 to couple the flexile handle 40 at one of the bench handles 312, 313. In particular, the fastening member 42 can be selectively slid at the handle portion or the root portion 312*a*, 313*a* of each of the bench handles 312, 313. Preferably, a width of the fastening member 42, i.e. the length of the receiving cavity thereof, is the same as a width of the flexible strip 41.

The handgrip 43 is an elongated rigid member for the exerciser to grasp thereat. Preferably, two ends of the handgrip 43 are affixed to the second end of the flexible strip 41. For example, when the fastening members 42 are coupled at the horizontal bench handles 312 respectively, the exerciser is able to grasp the handgrips 43 and to pull the press arms 311 by means of the flexible strips 41 respectively.

As shown in FIG. 2, each of the flexible handles 40 further comprises an additional tubular fastening member 44 affixed to the second end of the flexible strip 41 adjacent to the handgrip 43. Accordingly, the addition fastening member 44 is identical to the fastening member 42, such that each of the bench handles 312, 313 is adapted to slidably pass through the receiving cavity of the addition fastening member 44 to couple the flexile handle 40 at one of the bench handles 312, 313. It is worth mentioning that when the fastening members 42 are coupled at the one of bench handles 312, 313, the distance between the press arm 311 and the handgrip 43 will be prolonged by the flexible strip 41. Likewise, when the additional fastening members 44 are coupled at one of bench handles 312, 313, the distance between the press arm 311 and the handgrip 43 will be minimized since the additional fastening members 44 is located adjacent to the handgrip 43 at the second end of the flexible strip 41.

Each of the flexible handles 40 further comprises a plurality of attachment rings 45 spacedly coupled along the flexible strip 41 between the first and second ends thereof. In particular, the attachment rings 45 are spacedly provided on one of the flat surfaces 411 of the flexible strip 41 between the first and second ends thereof. Preferably, each of the attachment rings 45 is preferably a D-shaped ring that a flat side of the attachment ring 45 is coupled at the flat surface 411 of the flexible strip 41. As shown in FIG. 2, four attachment rings 45 are coupled along the flexible strip 41 at even intervals.

Figure 3:
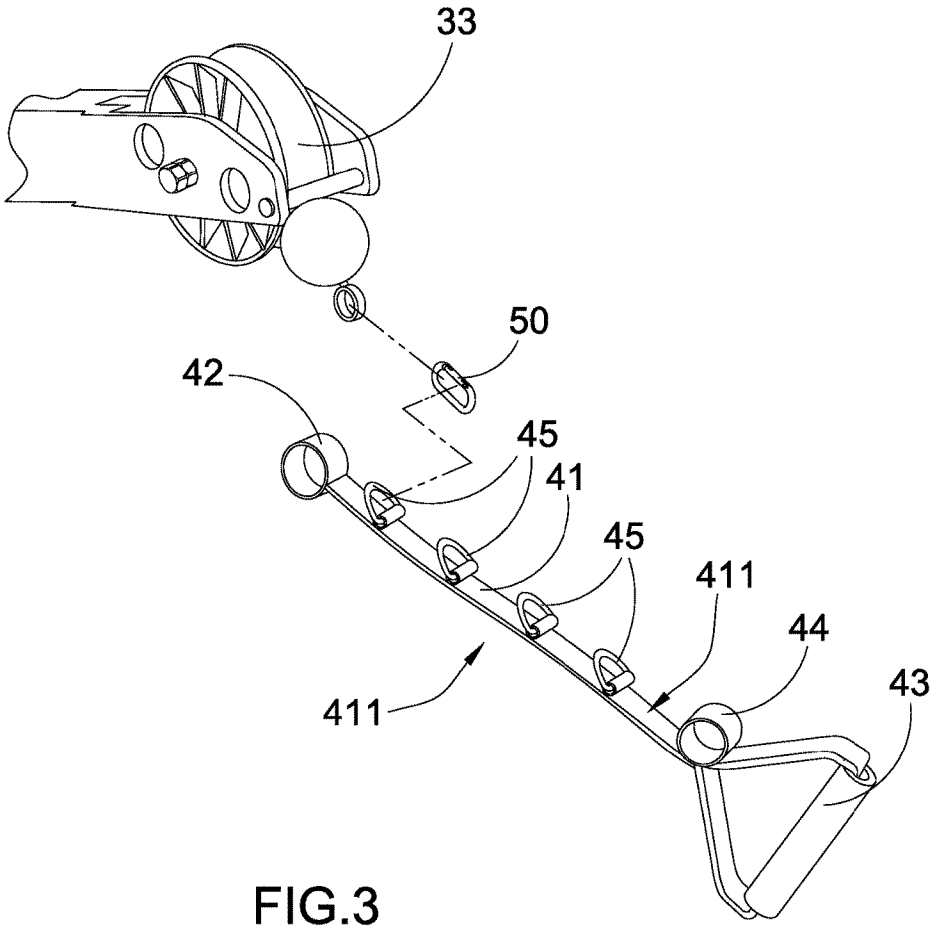
FIG. 3 illustrates the flexible handle being coupled at the pulley unit according to the above preferred embodiment of the present invention.

As shown in FIGS. 2 and 3, the handle assembly further comprises a fastening connector 50 which can be a quick releasable connector or a snap clip fastener, wherein the fastening connector 50 is detachably coupled with two of the attachment rings 45 at each flexible strip 41 to selectively adjust a length of the flexible handle 40 between the fastening member 42 and the handgrip end. Accordingly, the fastening connector 50 can be selectively coupled with any two or more of the attachment rings 45. For example, the fastening connector 50 can be detachably coupled with the first and third attachment rings 45 to shorten the length of the flexible handle 40 between the fastening member 42 and the end of the handgrip 43.

As shown in FIG. 3, the fastening connector 50 can also detachably coupled at the pulley unit 33, wherein one of the attachment rings 45 of the flexible handle 40 is detachably coupled at the fastening connector 50 for coupling with the pulley unit 33. Preferably, the fastening connector 50 is detachably coupled at the pulley unit 33 in place of the overhead pulldown handlebar 32 as shown in FIG. 3. It is worth mentioning that the pulley unit 33 is detachably and selectively coupled with one of the overhead pulldown handlebar 32 and the flexible handles 40. In other words, the user is able to select one of the overhead pulldown handlebar 32 and the flexible handles 40 to couple with the pulley unit 33 for performing different motions.

According to the preferred embodiment, the flexible handles 40 can be selectively and quickly coupled at different locations of the exercise machine, such as the press arms 311 or the pulley unit 33 at the overhead pulldown handlebar 32, for performing free motion press and fly exercises, such as PEC (pectoral) exercise, row exercise, LAT (latissimus) pulldown exercise. In addition, no screw or tool is required for coupling the flexible handles 40 at the exercise machine.

One skilled in the art will understand that the embodiment of the present invention as shown in the drawings and described above is exemplary only and not intended to be limiting.

It will thus be seen that the objectives of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An exercise machine, comprising: a supporting frame; a weight provider which is supported by said supporting frame for providing different adjustable resistance levels; a body exercising system operatively coupled at said supporting frame to link with said weight provider; and two flexible handles, each having a handgrip end and a coupling end detachably coupled at said body exercising system for enabling an exerciser to perform free motion press and fly exercises; each of said flexible handles comprises an elongated flexible strip, a tubular fastening member affixed to a first end of said flexible strip to form said coupling end, and a handgrip affixed to an opposed second end of said flexible strip to form said handgrip end;

and wherein each of said flexible handles further comprises an additional tubular fastening member affixed to said second end of said flexible strip.

2. The exercise machine, as recited in claim 1, wherein each of said flexible strips is a fabric strip having two opposed flat surfaces.

3. The exercise machine, as recited in claim 1, wherein each of said flexible strips is a fabric strip having two opposed flat surfaces.

4. The exercise machine, as recited in claim 2, wherein each of said flexible handles further comprises a plurality of attachment rings spacedly coupled on one of said flat surfaces of said flexible strip between said first and second ends thereof.

5. The exercise machine, as recited in claim 3, wherein each of said flexible handles further comprises a plurality of attachment rings spacedly coupled on one of said flat surfaces of said flexible strip between said first and second ends thereof.

6. The exercise machine, as recited in claim 1, wherein said body exercising system comprises two press arms pivotally coupled at said supporting frame, wherein each of said press arms comprises a horizontal bench handle and a tilted bench handle for providing two different hand orientations, wherein said coupling end of each of said flexible handles is detachably coupled at one of said horizontal bench handle and said tilted bench handle.

7. The exercise machine, as recited in claim 5, wherein said body exercising system comprises two press arms pivotally coupled at said supporting frame, wherein each of said press arms comprises a horizontal bench handle and a tilted bench handle for providing two different hand orientations, wherein said coupling end of each of said flexible handles is detachably coupled at one of said horizontal bench handle and said tilted bench handle.

8. The exercise machine, as recited in claim 7, wherein each of said horizontal bench handle and said tilted bench handle has a handle portion and a root portion that said fastening member of each of said flexible handles is slidably engaged at one of said handle portion and said root portion.

9. The exercise machine, as recited in claim 1, wherein said body exercising system further comprises a pulley unit operatively linked to said weight provider, and an overhead pulldown handlebar, wherein said pulley unit is detachably and selectively coupled with one of said overhead pulldown handlebar and said flexible handles.

10. The exercise machine, as recited in claim 1, wherein said body exercising system further comprises a pulley unit operatively linked to said weight provider, and an overhead pulldown handlebar, wherein said pulley unit is detachably and selectively coupled with one of said overhead pulldown handlebar and said flexible handles.

11. The exercise machine, as recited in claim 5, wherein said body exercising system further comprises a pulley unit operatively linked to said weight provider, and an overhead pulldown handlebar, wherein said pulley unit is detachably and selectively coupled with one of said overhead pulldown handlebar and said flexible handles.

12. The exercise machine, as recited in claim 9, further comprising a fastening connector coupled at said pulley unit, wherein one of said attachment rings of flexible handle is detachably coupled at said fastening connector to couple said flexible handle with said pulley unit.

13. The exercise machine, as recited in claim 10, further comprising a fastening connector coupled at said pulley unit, wherein one of said attachment rings of flexible handle is detachably coupled at said fastening connector to couple said flexible handle with said pulley unit.

14. The exercise machine, as recited in claim 11, further comprising a fastening connector coupled at said pulley unit, wherein one of said attachment rings of flexible handle is detachably coupled at said fastening connector to couple said flexible handle with said pulley unit.

15. A handle assembly for an exercise machine which comprises two press arms and a pulley unit for an overhead pulldown handlebar, wherein said handle assembly comprises: two flexible handles, each of said flexible handles comprising an elongated flexible strip, a fastening member affixed to a first end of said flexible strip to form a coupling end of said flexible handle for detachably coupling at the press arm, and a handgrip affixed to an opposed second end of said flexible strip to form a handgrip end of said flexible handle; wherein each of said flexible handles further comprises an additional tubular fastening member affixed to said second end of said flexible strip.

16. The handle assembly, as recited in claim 15, wherein each of said flexible strips is a fabric strip having two opposed flat surfaces, wherein each of said flexible handles further comprises a plurality of attachment rings spacedly coupled on one of said flat surfaces of said flexible strip between said first and second ends thereof for detachably coupling with the pulley unit.

17. The handle assembly, as recited in claim 15, wherein each of said flexible strips is a fabric strip having two opposed flat surfaces, wherein each of said flexible handles further comprises a plurality of attachment rings spacedly coupled on one of said flat surfaces of said flexible strip between said first and second ends thereof for detachably coupling with the pulley unit.

18. The handle assembly, as recited in claim 16, further comprising a fastening connector coupled at said pulley unit, wherein one of said attachment rings of said flexible handle is detachably coupled at said fastening connector for coupling said flexible handle with the pulley unit.

19. The handle assembly, as recited in claim 17, further comprising a fastening connector coupled at said pulley unit, wherein one of said attachment rings of said flexible handle is detachably coupled at said fastening connector for coupling said flexible handle with the pulley unit.

* * * * *